US009327420B2

(12) United States Patent
Koch

(10) Patent No.: US 9,327,420 B2
(45) Date of Patent: May 3, 2016

(54) SLICING MACHINE HAVING AN EXTERNAL CARRIAGE GUIDE AND KNIFE LOCKING

(75) Inventor: Nikolaus Koch, Geislingen (DE)

(73) Assignee: Bizerba GmbH & Co. KG, Balingen (DE)

( * ) Notice: Subject to any disclaimer, the term of this patent is extended or adjusted under 35 U.S.C. 154(b) by 490 days.

(21) Appl. No.: 13/824,640

(22) PCT Filed: Nov. 4, 2011

(86) PCT No.: PCT/EP2011/069380

§ 371 (c)(1),
(2), (4) Date: Apr. 8, 2013

(87) PCT Pub. No.: WO2012/059566

PCT Pub. Date: May 10, 2012

(65) Prior Publication Data

US 2013/0192440 A1 Aug. 1, 2013

(30) Foreign Application Priority Data

Nov. 5, 2010 (DE) ..... 10 2010 050 636

(51) Int. Cl.
*B26D 7/06* (2006.01)
*B26D 7/22* (2006.01)
*B26D 1/143* (2006.01)

(52) U.S. Cl.
CPC ..... *B26D 7/0616* (2013.01); *B26D 1/143* (2013.01); *B26D 7/225* (2013.01); *Y10T 83/6611* (2015.04)

(58) Field of Classification Search
CPC ..... B26D 7/225; B26D 7/0616; B26D 1/143; Y10T 83/6611; Y10T 83/6622; Y10T 83/6499; Y10T 83/76
USPC ..... 83/707
See application file for complete search history.

(56) References Cited

U.S. PATENT DOCUMENTS

| | | | | |
|---|---|---|---|---|
| 4,541,319 | A * | 9/1985 | Maurer | B26D 7/00 83/468 |
| 5,224,407 | A * | 7/1993 | Koch | B26D 7/01 83/42 |
| 5,687,626 | A * | 11/1997 | Scherch | B26D 7/00 83/719 |
| 6,016,734 | A | 1/2000 | Koch | |
| 2002/0069737 | A1 * | 6/2002 | Zhu | B26D 7/00 83/91 |

FOREIGN PATENT DOCUMENTS

| | | |
|---|---|---|
| DE | 44 29 628 | 2/1996 |
| DE | 200 20 065 | 3/2001 |
| DE | 201 18 836 | 2/2002 |
| EP | 0 823 314 | 2/1998 |
| FR | 2 905 624 | 3/2008 |
| WO | 96/05952 | 2/1996 |

* cited by examiner

*Primary Examiner* — Kenneth E. Peterson
*Assistant Examiner* — Samuel A Davies
(74) *Attorney, Agent, or Firm* — Michael J. Striker

(57) ABSTRACT

The slicing machine according to claim 12, characterized in that the device (18; 28) for setting the cutting thickness of the product to be sliced can be actuated via an adjusting device disposed in the installation space (B; B'), wherein the passage region of the device (18; 28) through the machine housing (11; 21) is sealed at least against splash water.

13 Claims, 8 Drawing Sheets

SLICING MACHINE HAVING AN EXTERNAL CARRIAGE GUIDE AND KNIFE LOCKING

CROSS-REFERENCE TO A RELATED APPLICATION

Figure 1A:
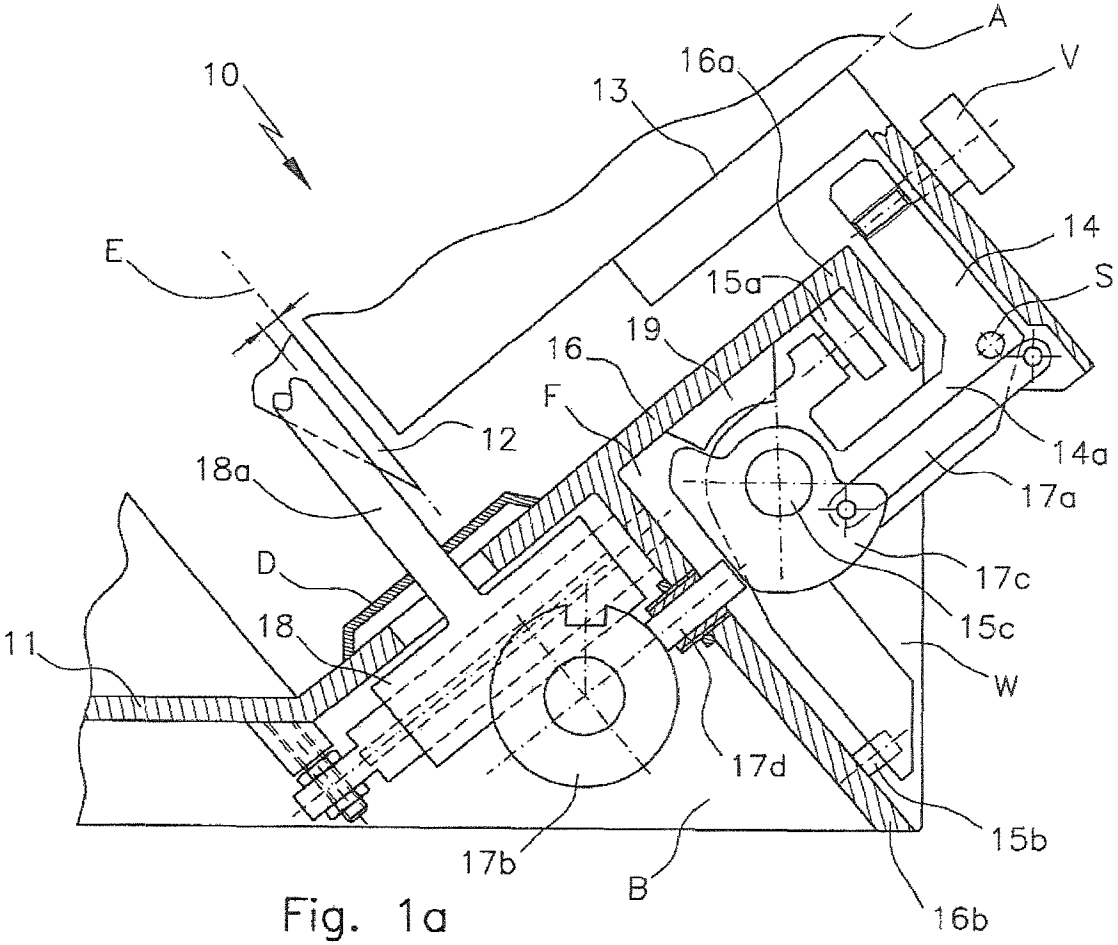

The invention described and claimed hereinbelow is also described in German patent Application 10 2010 050 636.2 filed on Nov. 5, 2010. This German Patent Application, whose subject matter is incorporated here by reference, provide the basis for a claim of priority of invention under 35 U.S.C. 119 (a)-(d).

The invention relates to an electrically operated slicing machine for cutting slices from material to be cut, which is strand-shaped in particular and is preferably a foodstuff, the slicing machine comprising a cutting device, which has a circular knife, which is mounted in a machine housing and rotates in a cutting plane, and comprising a carriage, which carries a substantially flat support plate having a support surface for placement of the material to be cut, wherein the carriage is guided parallel to the cutting plane by means of a carriage base along a sliding rail rigidly connected to the machine housing and can be displaced parallel to the plane of the support plate, and comprising a device for setting the cutting thickness of the material to be cut, which has a stop plate, wherein the carriage base can be locked or released for a tilting motion of the carriage base by means of a first push rod, which interacts with a plate cam designed to adjust the stop plate.

Such slicing machines are known, for example, from EP 0 823 314 A1 or WO 96/05952 A1.

The product to be sliced, more particularly in automatically operated slicing machines for strand-shaped foodstuffs such as sausage, ham, salmon, cheese, etc., is moved against the cutting device with the aid of a feed device, usually in a direction perpendicular to the cutting plane in which usually one or more rotating circular knives rotate, in order to cut slices off of the conveyed product to be sliced. The cutting device is driven by an electric motor, which is fully enclosed by the machine housing as protection against splash water and contamination and as a mechanical safeguard against penetration from the outside.

In order to now separate the desired slice from the product to be sliced by way of the rotating cutter, the product to be sliced, which is lying on the support surface of the support plate, is moved parallel to the cutting plane using a carriage and is fed toward the rotating cutter blade until the rotating cutter has cut completely through the product to be sliced and has cut the slice off of the product to be sliced. The support plate is usually rigidly connected to a carriage base, which extends downward from the support plate and is movably supported on a sliding rail, which itself is rigidly connected to the machine housing.

Such a design is described in DE 200 20 065 U1, for example. In that case, the carriage base bears upwardly against the sliding rail by way of an external carriage guide, wherein additional sliding surfaces for absorbing torques that occur are provided on the machine housing, on which the sliding surfaces the carriage base rests in such a way that it slides from above.

Two-point support is provided in the slicing machine comprising an internal carriage guide, which is described in DE 201 18 836 U1, wherein the carriage base is supported on a sliding rail and is additionally supported from above by means of a roller on a roller rail rigidly connected to the machine housing.

Three-point support of the carriage base via a sliding rail and via two roller-shaped support elements is depicted in the initially-mentioned document EP 0 823 314 A1. In this case, however, the carriage guide is disposed outside of the machine housing in an exposed manner and is therefore extremely susceptible to contamination and is not entirely suitable for use in such a hygienically sensitive manner such as in the food industry.

By comparison, the slicing machine described in WO 96/05952 A1, which was also initially cited, can be cleaned in an improved manner and maintained in a simpler manner.

In the case of such slicing machines for professional use, however, it is also necessary to tilt the carriage outward for cleaning purposes. For safety reasons, however, the stop plate must first be advanced if the cutting thickness is set to less than zero. Document WO 96/05952 A1 shows a knife safety locking device, which permits the carriage to be swung only when the cutting thickness is set to less than zero. However, this design does not offer absolute protection against splash water.

The problem addressed by the present invention is that of improving a slicing machine, which is of the type in question as initially described, in a low-cost manner and using simple technical means such that the machine has the most compact design possible and optimum workplace safety due to reliable safety locking of the knife, and which provides the housing with a high level of protection from splash water, improves hygiene during machine operation, and further improves handling during cleaning and, in particular, protection in the direction of the cutting region.

This problem is solved according to the invention in a manner that is as surprisingly simple as it is effective in that the first push rod acts on a locking disc, which is rotatably supported on the sliding rail and has a control contour, which interacts via a second push rod with the plate cam to release or lock a rotational motion of the locking disc and, therefore, a tilting motion of the carriage base, in that the machine housing has a separating wall extending at least partially between the support plate and the carriage base, which, on the side thereof facing away from the support plate, partially encloses a guide space in which the sliding rail is disposed, and in that the second push rod extends through the separating wall.

It is thereby ensured that the housing is largely sealed against splash water and that the guide elements of the carriage are spatially separated from the dripping region of the product to be sliced—e.g., from dripping meat juices—and that the food region is separated from components having bearing grease or increased residue from wear, using low-cost means due simply to the geometry of the arrangement. In addition, maintenance is simplified and it becomes possible to clean this region underneath the support plate, which is particularly susceptible to contamination. The external carriage guide is easy to access and, therefore, easy to keep clean, thereby making it possible to minimize the effects of contamination on the quality of the product to be sliced or to even rule out such effects entirely by way of careful operation.

The slicing machine according to the invention can be embodied as a vertical slicing machine or as a slanted slicing machine.

According to a particularly preferred embodiment of the slicing machine according to the invention, the second push rod is designed as a spring-loaded bolt, which is routed through the separating wall, preferably in a manner sealed against splash water, and transfers the motion of the locking disc onto the plate cam, thereby resulting in automatic guidance.

Embodiments in which the plate cam is designed as a grooved disc provide increased variability in the geometric design and operation of the slicing machine according to the invention. Such a grooved disc is easy to produce and can be easily modified in an individualized manner for the particular application.

Embodiments in which the plate cam is designed such that it can be actuated synchronously with the device for setting the cutting thickness are also advantageous in terms of handling and operation. This relatively simple modification makes it possible to automatically lock and release the mechanism.

A first class of embodiments of the slicing machine according to the invention is characterized in that the locking disc and the second push rod are designed and disposed such that movement of the locking disc is transferred directly to the second push rod, and swinging-out can take place only in one defined position.

In another class of embodiments of the invention, the locking disc can be displaced synchronously with the carriage on the sliding rail, and a locking rib is provided on the machine housing, which, in a certain angular position of the locking disc about the sliding rail, interacts with a profile of the machine housing such that the carriage can be swung out only in a certain axial position of the carriage relative to the sliding rail, in particular in an end position.

A type of support that moves particularly easily is obtained when the locking disk is mounted on the sliding rail in a rotatable and axially displaceable by means of a guide bush. It is thereby possible to effectively prevent the locking disc from tilting.

In developments of this class of embodiments, depending on the special application of the machine, the profile can be integrally formed, cast, bonded, or screwed on the machine housing. A screwed connection, in particular, allows the profile to be easily replaced.

A third class of embodiments of the slicing machine according to the invention has also proven effective in practical application, namely that in which a swivellably supported locking strip is provided, which is disposed such that it transfers the motion of the locking disc to the second push rod. In particular, the locking strip extends parallel to the sliding rail along a path that corresponds to the displacement travel of the carriage, thereby allowing the swinging-out to take place on the entire line.

In a further advantageous embodiment of the slicing machine according to the invention, the sliding rail is mounted or attached at both of the opposite end faces thereof, in an end wall of the machine housing in each case, and the two end walls of the separating wall cover the enclosed guide space on both end faces. This combination of measures ensures that the torques acting on the two separating wall sections are absorbed in an optimum manner and that hygiene is further improved by minimizing the influences of contamination.

A very particularly preferred class of embodiments of the invention is characterized in that the carriage base is supported such that it is movable relative to the machine housing via at least two support elements, and in that the at least two support elements are displaceably accommodated within the guide space and are supported against the separating wall, wherein the first support element, in an operating state of the slicing machine, bears from below against the surface of a first separating wall section of the separating wall facing away from the carriage, the separating wall section extending underneath the support plate, parallel to the plane of the support plate, and in that the separating wall comprises a second separating wall section, which extends straight or obliquely downward relative to the first separating wall section, wherein the second support element is laterally supported against the second separating wall section. The two-piece design and the geometric arrangement of the separating wall, in particular, allow for a particularly compact design of the carriage base. The geometry of the support upwardly against the first separating wall section and toward the side against the second separating wall section, in combination with the third support point on the sliding rail, ensures a stable three-point support with the forces and torques balanced out in an optimal manner, more particularly in the maintenance position of the support plate, which is tilted with respect to the operating state.

Even more effective protection of the carriage base region of the slicing machine against effects of contamination from the food region (and vice versa) and, therefore, improved hygiene, are ensured via an embodiment of the invention in which the first separating wall section is angled downward on the edge in such a way that the first support element is covered toward the outside by the bent region of the first separating wall section.

Embodiments of the slicing machine according to the invention that are advantageous in terms of further improvement of hygiene are those in which the second separating wall section, in combination with further parts of the machine housing and a removable base plate, forms an installation space, which is sealed at least against splash water, for accommodating drive parts and/or electronic elements of the slicing machine. As a result, protection of sensitive components against harmful external influences such as splash water or dust formation is also ensured.

In a development of these embodiments that is preferred and easy to manufacture, the device for setting the cutting thickness of the product to be sliced can be actuated via an adjusting device disposed in the installation space, wherein the passage region of the device through the machine housing is at least sealed against splash water.

The support plate preferably comprises a juice channel for fluid drainage in the support surface for the product to be sliced. This juice channel prevents meat juices from leaving the support surface in an uncontrolled manner during cutting of sausage or meat products by capturing the juices and carrying them away in a defined manner.

Further features and advantages of the invention will become apparent from the detailed description of exemplary embodiments of the invention that follows, with reference to the figures in the drawing, which shows the details that are essential to the invention. Further features and advantages of the invention will also become apparent from the claims. The individual features may be implemented individually, or they may be combined in any possible manner to form variants of the invention.

Exemplary embodiments of the invention are depicted in the schematic drawing and are described in greater detail in the description that follows.

Figure 1B:
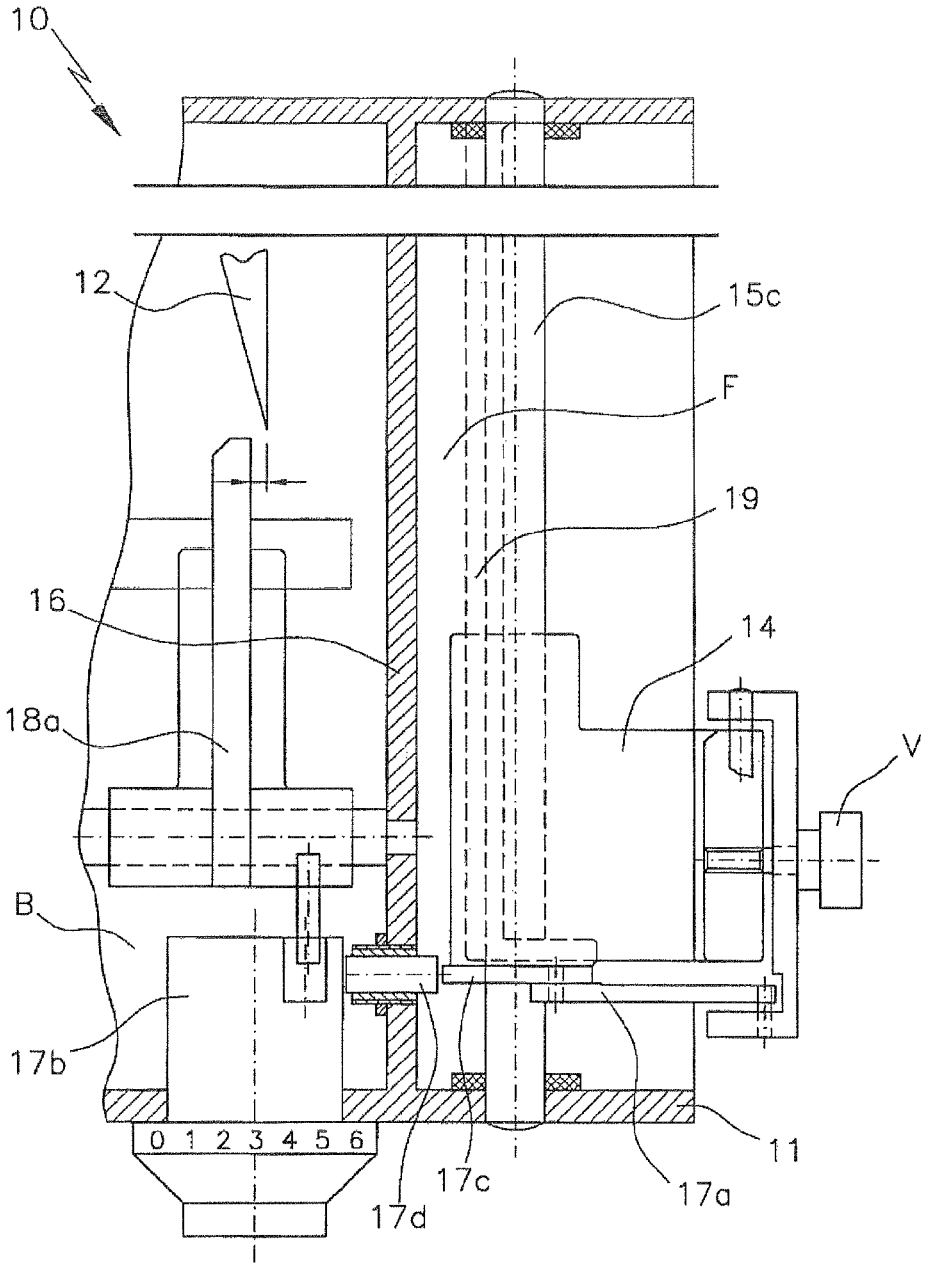
Figure 1C:
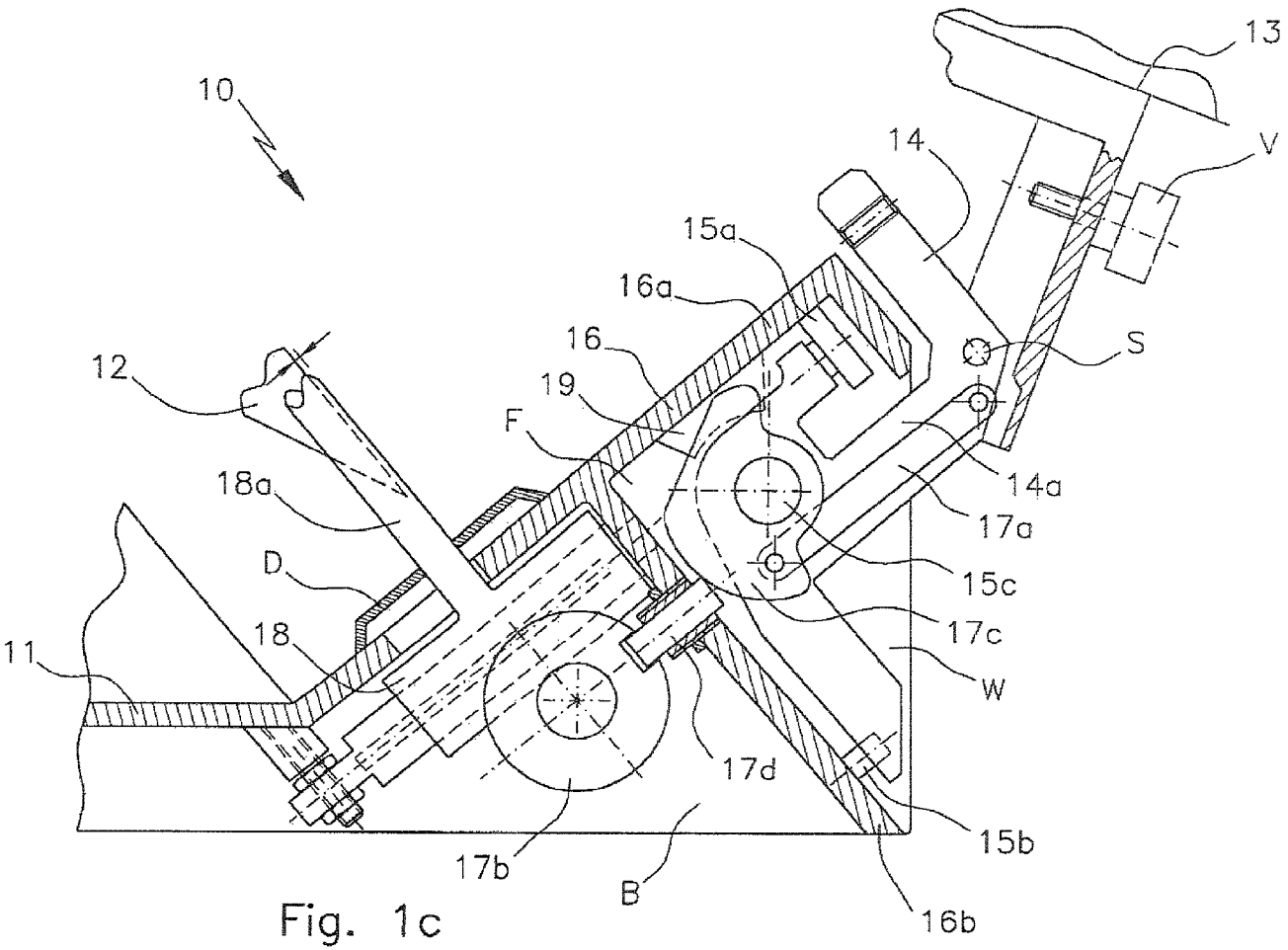
Figure 1D:
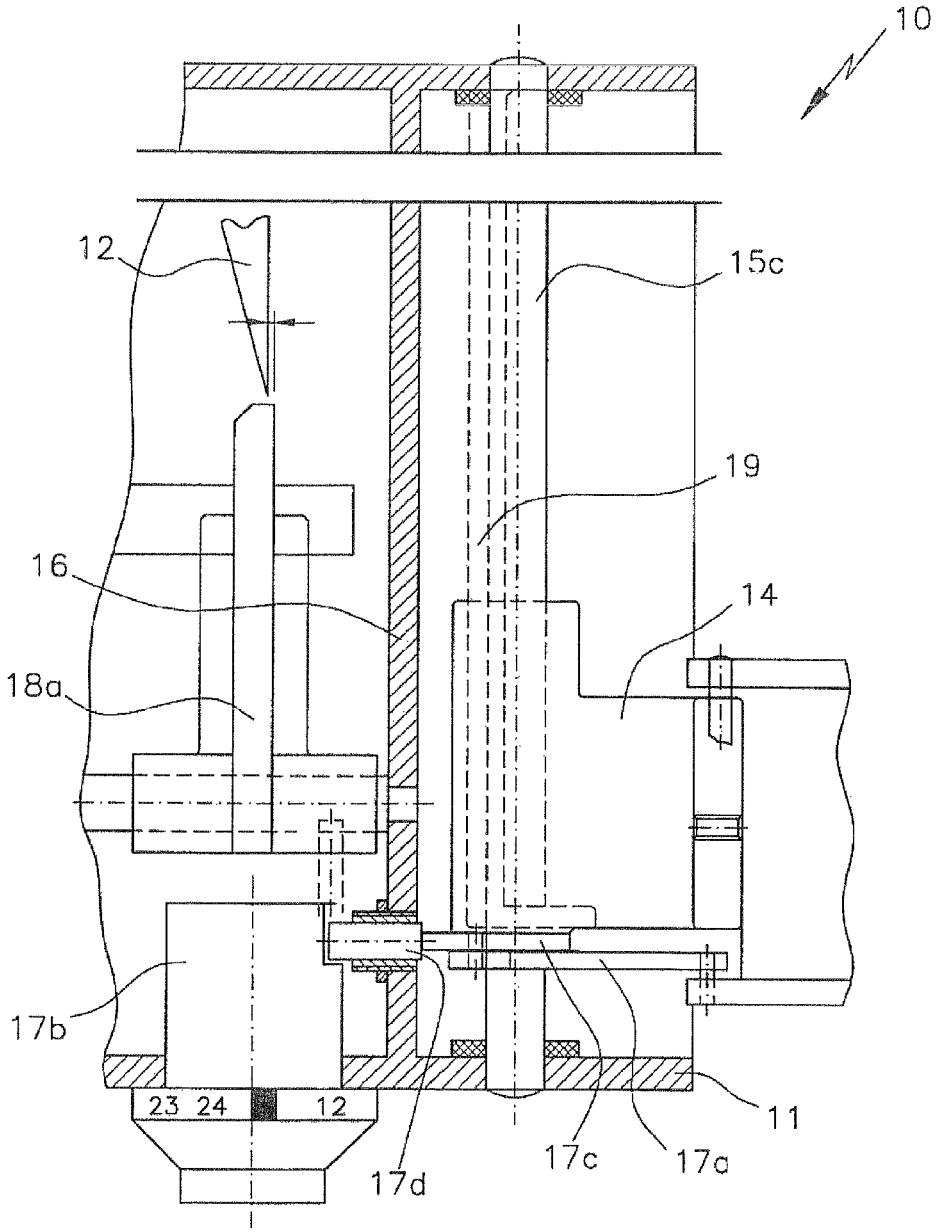
Figure 2A:
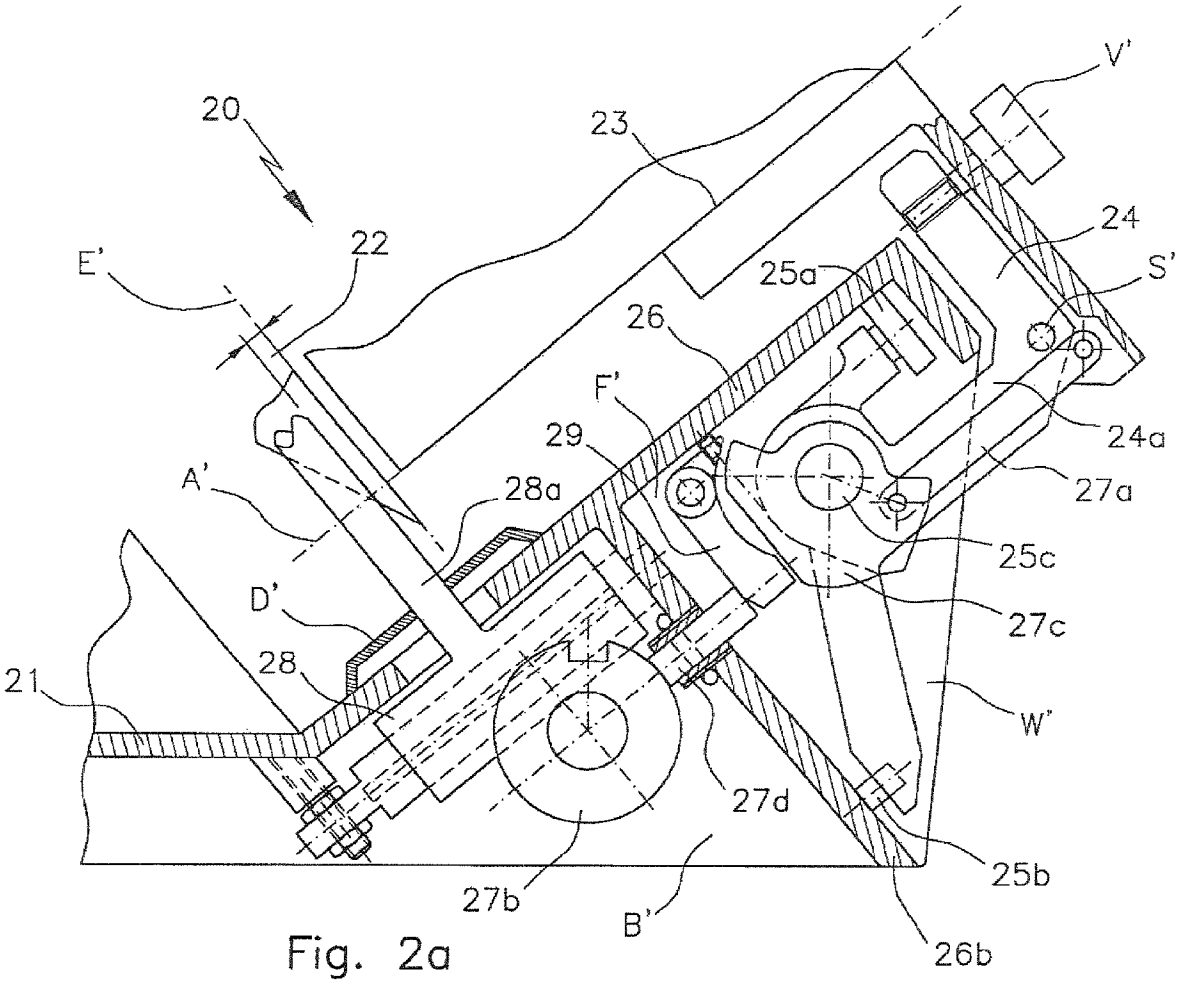
Figure 2B:
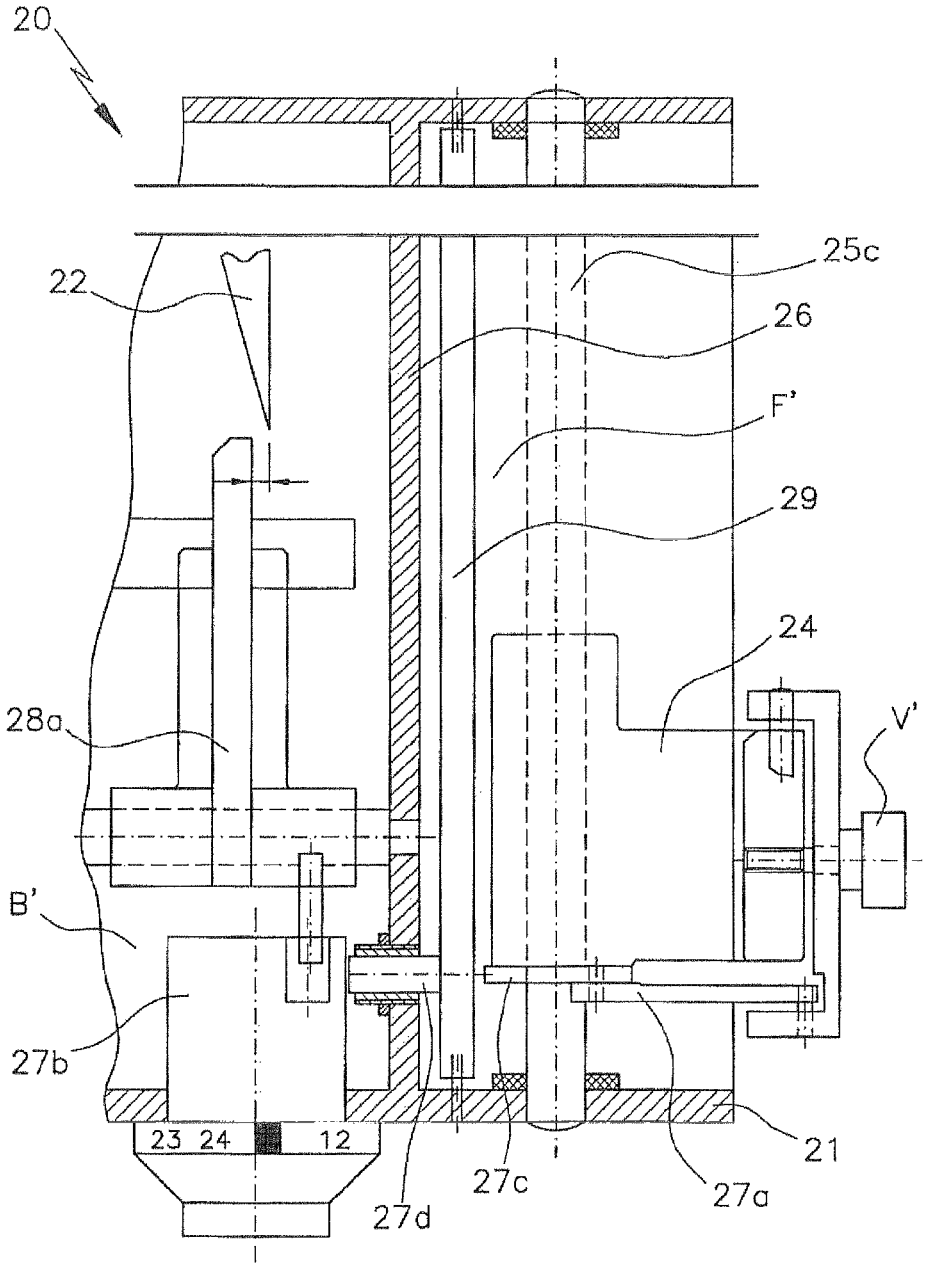
Figure 2C:
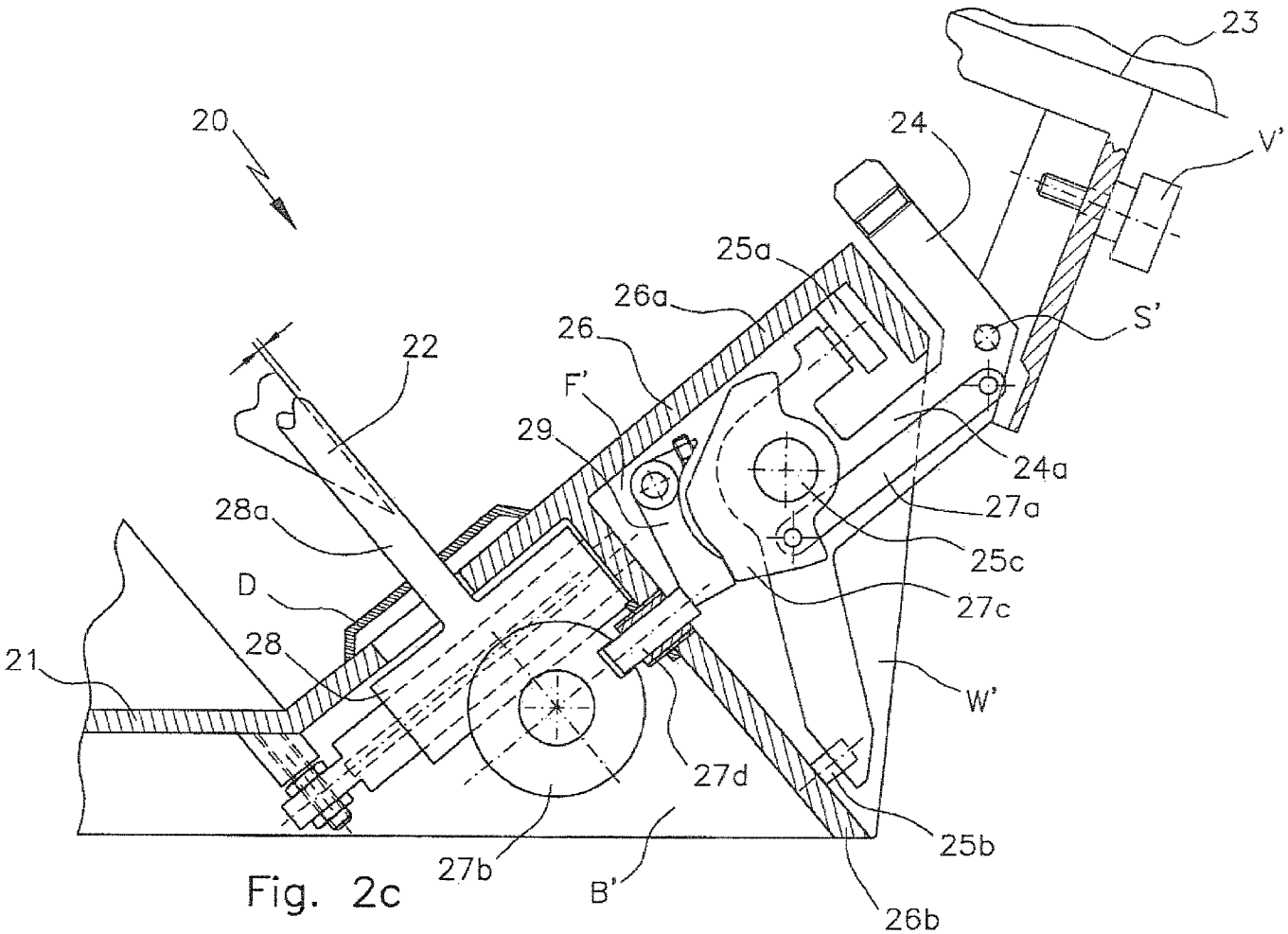
Figure 2D:
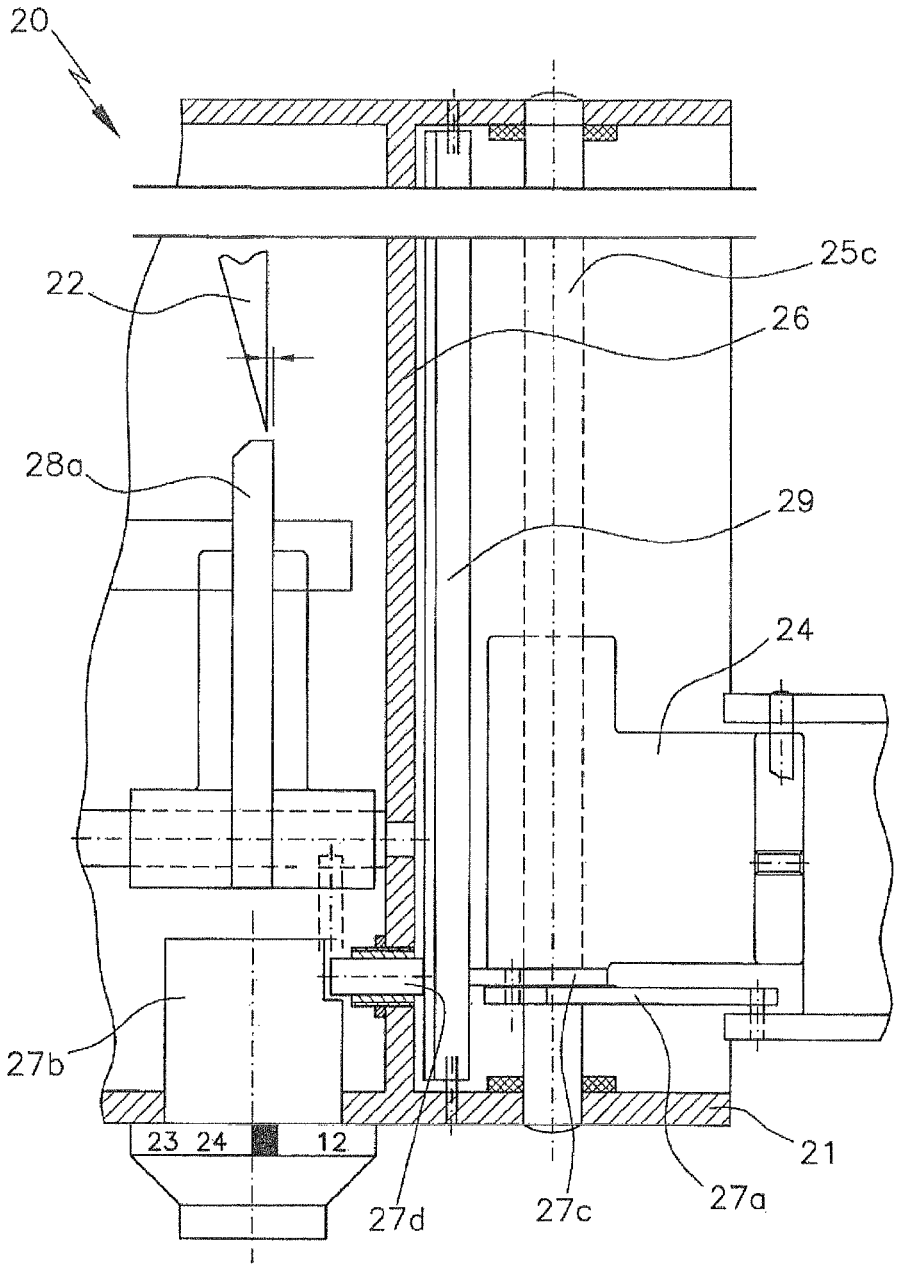

Wherein:

FIG. 1*a* shows a schematic vertical sectional view in a plane perpendicular to the cutting plane of the circular knife of an embodiment of the slicing machine according to the invention, comprising a locking rib in the operating state with the carriage base folded down and an opened device for setting the cutting thickness of the product to be sliced;

FIG. 1*b* shows the embodiment according to FIG. 1*a* in a sectional view of the machine from the top;

FIG. 1*c* shows the same depiction as FIG. 1*a*, but with the carriage base folded up and with the device for setting the slicing thickness locked;

FIG. 1*d* shows the embodiment according to FIG. 1*c* in a sectional view from above;

FIG. 2*a* shows a schematic vertical sectional view in a plane perpendicular to the cutting plane of an embodiment having a locking strip in the operating state with the carriage base folded down and an opened device for setting the cutting thickness of the product to be sliced;

FIG. 2*b* shows the embodiment according to FIG. 2*a* in a sectional view of the machine from above;

FIG. 2*c* shows the same depiction as FIG. 2*a*, but with the carriage base folded up and with the device for setting the slicing thickness locked; and FIG. 2*d* shows the embodiment according to FIG. 2*c* in a sectional view from above.

The figures of the drawing show details of two embodiments (comprising a locking rib in FIGS. 1*a* to 1*d* and comprising a locking strip in FIGS. 2*a* to 2*d*) of the electrically operated slicing machine 10; 20 according to the invention, which is usually automatic, for cutting slices from product to be sliced, which is strand-shaped in particular and is preferably a foodstuff.

The slicing machine 10; 20 comprises a cutting device, which has a circular knife 12; 22, which is rotatably supported in a machine housing 11; 21 and rotates in a cutting plane E; E'. The slicing machine 10; 20 further comprises a substantially flat support plate 13; 23 having a support surface for placement of the product to be sliced, which is carried by a carriage 14; 24, which is guided parallel to the cutting plane E; E via a carriage base 14*a*; 24*a* along a sliding rail 15*c*; 25*c* rigidly connected to the machine housing 11; 21, the carriage being displaceable parallel to the plane A; A' of the support plate 13; 23.

As shown in FIGS. 1*a* and 2*a*, for example, the support plate 13; 23 of the slanted slicing machine 10; 20 shown is in a position tilted at a slant with respect to the horizontal, in which it is rigidly attached to the carriage 14; 24 via a screw connection, for example. In FIGS. 1*c* and 2*c*, this attachment is released and the support plate 13; 23 is tilted about a horizontal pivot axis S; S' with respect to the carriage 14; 24, in order to perform cleaning or maintenance, for example.

Alternatively, in embodiments that are not depicted in the drawing, the slicing machine according to the invention can also be in the form of a vertical slicing machine having a different tilt angle, wherein the support plate is also pivotable in that case.

Closing elements V; V' such as threaded screws or bolts are provided in order to fix the support plate 13; 23 in the non-swiveled position in the operating state of the slicing machine 10; 20 according to the invention.

In the embodiments shown, the carriage base 14*a*; 24*a* is supported via at least two support elements *a*,15*b*; 25*a*, 25*b* in such a way that it is movable relative to the machine housing 11; 21, which comprises a separating wall 16; 26, which extends at least partially between the support plate 13; 23 and the carriage base 14*a*; 24*a* and encloses, on the side thereof facing away from the support plate 13; 23, a guide space F; F' in which the sliding rail 15*c*; 25*c* is also disposed. The support elements 15*a*, 15*b*; 25*a*, 25*b* are movably accommodated within the guide space F; F' and are supported against the surface of the separating wall 16; 26 facing away from the carriage 14; 24, wherein, in the operating state of the slicing machine 10; 20, the first support element 15*a*; 25*a* bears from below against the surface—facing away from the carriage 14; 24—of a first separating wall section 16*a*; 26*a* of the separating wall 16; 26, which extends underneath the support plate 13; 23 parallel to the plane A; A' of the support plate 13; 23, and wherein the separating wall 16; 26 comprises a second separating wall section 16*b*; 26*b*, which extends downwardly in a straight or slanted manner at an angle with respect to the first separating wall section 16*a*; 26*a*, wherein the second support element 15*b*; 25*b* bears laterally against the second separating wall section 16*b*; 26*b*.

The carriage base 14*a*; 24*a* can be locked or released for a tilting motion of the carriage base by means of a first push rod 17*a*; 27*a*, which interacts with a plate cam 17*b*; 27*b* designed to adjust the stop plate 18*a*; 28*a* of a device 18; 28 for setting the cutting thickness of the product to be cut. The stop plate 18*a*; 18*b* can be actuated via an adjusting device disposed in the installation space B; B', wherein the passage region of the device 18; 28 through the machine housing 11; 21 is sealed at least against splash water. Sealing elements D; D', which are depicted merely schematically in the drawing, can be provided for this purpose.

According to the invention, the first push rod 17*a*; 27*a* acts on a locking disc 17*c*; 27*c*, which is rotatably supported on the sliding rail 15*c*; 25*c* and has a control contour, which interacts via a second push rod 17*d*; 27*d* with the control disc 17*b*; 27*b* to release or lock a rotational motion of the locking disc 17*c*; 27*c* and, therefore, a tilting motion of the carriage base 14*a*; 24*a*, wherein the second push rod 17*d*; 27*d* extends through the separating wall 16; 26.

In the embodiment of the slicing machine 10 according to the invention, as shown in FIGS. 1*a* to 1*d*, the locking disc 17*c* and the second push rod 17*d* are designed and disposed such that movement of the locking disc 17*c* can be transferred directly to the second push rod 17*d*. In particular, the locking disc 17*c* can be displaced synchronously with the carriage 14 on the sliding rail 15*c*, and a locking rib 19 is provided on the machine housing 11, which, in a certain angular position of the locking disc 17*c* about the sliding rail 15*c*, interacts with a profile of the machine housing 11 such that the carriage 14 can be swung out only in a certain axial position of the carriage 14 relative to the sliding rail 15, preferably in an end position. The profile can be integrally formed, cast, bonded, or screwed on the machine housing 11.

In contrast thereto, an embodiment of the invention is shown in FIGS. 2*a* to 2*d* in which a pivotably supported locking strip 29 is disposed such that it transfers the movement of the locking disc 27*c* to the second push rod 27*d*.

In the operating state of the slicing machine 10; 20 depicted in FIGS. 1*a* and 2*a*, the center of gravity of the support plate 13; 23 is located between the cutting plane E; E' and the first support element 15*a*; 25*a*.

The first separating wall section 16*a*; 26*a* is angled downward on the edge in such a way (straight or slanted) that the first support element 15*a*; 25*a* is covered toward the outside by the bent region of the first separating wall section 16*a*; 26*a*.

The second separating wall section 16*b*; 26*b*, in combination with further parts of the machine housing 11; 21 and a removable base plate, which is not shown in the figures of the drawing, forms an installation space B; B', which is sealed at least against splash water, for accommodating drive parts and/or electronic elements of the slicing machine 10; 20.

The support elements 15*a*, 15*b*; 25*a*, 25*b* are preferably attached at the carriage base 14*a*, 24*a* in such a manner that the clearance thereof from the separating wall 16; 26 can be adjusted. In embodiments of the invention they can be designed as rollers or sliding pins, which are adjustable via threads or eccentrics in particular. In addition, the separating wall 16; 26 can comprise a preferably replaceable sliding support or rail in the region of the support points of the support elements 15*a*, 15*b*; 25*a*, 25*b*, or tracks can be installed or integrally formed in the separating wall 16; 26. These elements are not depicted separately in the drawing.

The figures of the drawing merely indicate that the sliding rail 15*c*; 25*c* can be mounted or attached at both of the opposite end faces thereof in an end wall W; W' of the machine housing 11; 21, wherein the two end walls cover the guide space F; F' enclosed by the separating wall 16; 26 on both end faces. Strengthening ribs, which protrude from the separating wall 16; 26 and extend into the guide space F; F', are not depicted separately in the drawing.

Embodiments are also not shown in which the support plate 13; 23 comprises a juice channel for fluid drainage in the support surface for the product to be sliced.

The invention claimed is:

1. An electrically operated slicing machine (10; 20) for cutting slices from material to be cut, which is strand-shaped in particular and is preferably a foodstuff, the slicing machine comprising a cutting device, which has a circular knife (12; 22), which is mounted in a machine housing (11; 21) and rotates in a cutting plane (E; E'), and comprising a carriage (14; 24), which carries a substantially flat support plate (13; 23) having a support surface for placement of the material to be cut, wherein the carriage is guided parallel to the cutting plane (E; E') by means of a carriage base (14*a*; 24*a*) along a sliding rail (15*c*; 25*c*) rigidly connected to the machine housing (11; 21) and can be displaced parallel to the plane (A; A') of the support plate (13; 23), and comprising a device (18; 28) for setting the cutting thickness of the material to be cut, which has a stop plate (18; 28*a*), wherein the carriage base (14*a*; 24*a*) can be locked or released for a tilting motion of the carriage base by means of a first push rod (17*a*; 27*a*), which interacts with a plate cam (17*b*; 27*b*) designed to adjust the stop plate (18*a*; 28*a*), characterized in that the first push rod (17*a*; 27*a*) acts on a locking disc (17*c*; 27*c*), which is rotatably supported on the sliding rail (15*c*; 25*c*) and has a control contour, which interacts via a second push rod (17*d*; 27*d*) with the plate cam (17*b*; 27*b*) to release or lock a rotational motion of the locking disc (17*c*; 27*c*) and, therefore, a tilting motion of the carriage base (14*a*; 24*a*), the machine housing (11; 21) comprises a separating wall (16; 26) extending at least partially between the support plate (13; 23) and the carriage base (14*a*; 24*a*), the separating wall partially enclosing, on the side thereof facing away from the support plate (13; 23), a guide space (F; F') in which the sliding rail (15*c*; 25*c*) is disposed, and the second push rod (17*d*; 27*d*) extends through the separating wall (16; 26).

2. The slicing machine according to claim 1, characterized in that the second push rod (17*d*; 27*d*) is designed as a spring-loaded bolt, which is routed through the separating wall (16; 26), preferably in a manner sealed against splash water, and transfers the motion of the locking disc (17*c*; 27*c*) onto the plate cam (17*b*; 27*b*).

3. The slicing machine according to claim 1, characterized in that the plate cam (17*b*; 27*b*) is designed as a grooved disc.

4. The slicing machine according to claim 1, characterized in that the plate cam (17*b*; 27*b*) is designed such that it can be actuated synchronously with the device (18; 28) for setting the cutting thickness of the product to be cut.

5. The slicing machine according to claim 1, characterized in that the plate cam (17*c*) and the second push rod (17*d*) are designed and disposed such that a movement of the plate cam (17*c*) is transferred directly to the second push rod.

6. The slicing machine according to claim 1, characterized in that the locking disc (17*c*) can be displaced synchronously with the carriage (14) on the sliding rail (15*c*), and a locking rib (19) is provided on the machine housing (11), which, in a certain angular position of the locking disc (17*c*) about the sliding rail (15*c*), interacts with a profile of the machine housing (11) such that the carriage (14) can be swung out only in a certain axial position of the carriage (14) relative to the sliding rail (15*c*), in particular in an end position.

7. The slicing machine according to claim 6, characterized in that the profile is integrally formed, cast, bonded, or screwed on the machine housing (11).

8. The slicing machine according to claim 1, characterized in that a pivotably supported locking strip (29) is disposed such that it transfers the movement of the locking disc (27*c*) to the second push rod (27*d*).

9. The slicing machine according to claim 1, characterized in that the sliding rail (15*c*; 25*c*) is mounted or attached at both of the opposite end faces thereof in an end wall of the machine housing (11; 21), and in that the two end walls cover the guide space (F; F') enclosed by the separating wall (16; 26) on both end faces.

10. The slicing machine according to claim 1, characterized in that the carriage base (14*a*; 24*a*) is supported such that it is movable relative to the machine housing (11; 21) via at least two support elements (15*a*, 15*b*; 25*a*, 25*b*), and in that the at least two support elements (15*a*,15*b*; 25*a*, 25*b*) are movably accommodated within the guide space (F; F') and bear against the separating wall (16; 26), wherein, in an operating state of the slicing machine (10; 20), the first support element (15*a*; 25*a*) bears from below against the surface of a first separating wall section (16*a*; 26*a*) of the separating wall (16; 26) that faces away from the carriage (14; 24), the separating wall extending underneath the support plate (13; 23) parallel to the plane (A; A') of the support plate (13; 23), and in that the separating wall (16; 26) comprises a second separating wall section (16*b*; 26*b*) that extends downwardly in a straight or slanted manner at an angle with respect to the first separating wall section (16*a*; 26*a*), wherein the second support element (15*b*; 25*b*) bears laterally against the second separating wall section (16*b*; 26*b*).

11. The slicing machine according to claim 10, characterized in that the first separating wall section (16*a*; 26*a*) is angled downward on the edge in such a way that the first support element (15*a*; 25*a*) is covered toward the outside by the angled region of the first separating wall section (16*a*; 26*a*).

12. The slicing machine according claim 10, characterized in that the second separating wall section (16*b*; 26*b*), in combination with further parts of the machine housing (11; 21) and a removable base plate, forms an installation space (B; B'), which is sealed at least against splash water, for accommodating drive parts and/or electronic elements of the slicing machine (10; 20).

13. The slicing machine according to claim 12, characterized in that the device (18; 28) for setting the cutting thickness of the product to be sliced can be actuated via an adjusting device disposed in the installation space (B; B'), wherein the passage region of the device (18; 28) through the machine housing (11; 21) is sealed at least against splash water.

* * * * *